US005426897A

United States Patent [19]

Gazaway

[11] Patent Number: 5,426,897

[45] Date of Patent: Jun. 27, 1995

[54] GLASS RESTRAINT SYSTEM AND WINDOWS

[76] Inventor: Vaden S. Gazaway, 882 Clarkston Dr., San Jose, Calif. 95136

[21] Appl. No.: 176,537

[22] Filed: Jan. 3, 1994

[51] Int. Cl.[6] ..... E06B 1/04

[52] U.S. Cl. ..... 52/204.53; 52/204.62; 52/718.04

[58] Field of Search ..... 52/717.01, 718.04, 718.05, 52/204.705, 204.53, 204.62, 772, 780

[56] References Cited

U.S. PATENT DOCUMENTS

| | | | |
|---|---|---|---|
| 1,815,715 | 7/1931 | Kellogg | 52/204.53 |
| 4,075,802 | 2/1978 | Gross et al. | 52/203 |
| 4,103,728 | 8/1978 | Burdette et al. | 160/368 |
| 4,112,642 | 9/1978 | D'Aragon | 52/202 |
| 4,161,853 | 7/1979 | Weiss et al. | 52/288.1 |
| 4,182,088 | 1/1980 | Ball | 52/202 |
| 4,189,880 | 2/1980 | Ballin | 52/202 |
| 4,319,623 | 3/1982 | Krogseng et al. | 160/90 |
| 4,453,585 | 6/1984 | Ruggeberg et al. | 160/354 |
| 4,473,980 | 10/1984 | Foster | 52/202 |
| 5,222,343 | 6/1993 | Anderson | 52/717.01 X |

FOREIGN PATENT DOCUMENTS

| | | | |
|---|---|---|---|
| 2228605 | 1/1974 | Germany | 52/717.01 |
| 3127631 | 1/1983 | Germany | 52/204.62 |
| 3142690 | 5/1983 | Germany | 52/204.62 |

*Primary Examiner*—Lanna Mai

*Attorney, Agent, or Firm*—Claude A. S. Hamrick

[57] ABSTRACT

Glass restraint system for windows, including a film, means for adhesively affixing it to a window pane, and a securing means for clamping the edges of the film to the window frame or mullion and providing an aesthetically pleasing cap and seal around the window. The securing means includes a trough-shaped baseplate with upwardly projecting sides, the outer surfaces of which have captivation grooves extending along the length of the baseplate, and an inverted trough-shaped cap having a top and two sides which fit over the baseplate. The sides of the cap are provided with inwardly protruding ribs on the inside faces that are configured to snap into the captivation grooves for securing the cap to the baseplate so that the cap and baseplate form a four-sided, substantially rectangular framing assembly. The cap also has at least one narrow protruding rib extending inwardly on the window facing side from the level of the cap top, the rib being configured so as to leave a small gap between the rib and the window pane. A flexible gasket is engaged by the rib or ribs and used to maintain a sealing pressure against the film covering the window to prevent moisture and other contaminants from accumulating behind the cap.

8 Claims, 3 Drawing Sheets

GLASS RESTRAINT SYSTEM AND WINDOWS

BACKGROUND OF THE INVENTION

1. Field of the Invention

The present invention relates generally to glass window and window wall safety systems, and more particularly to an improved system for restraining glass within an opening using a glass covering membrane in combination with an apparatus for clamping the edges of the membrane to a frame circumscribing the windowed opening.

2. Description of the Prior Art

Window film has been applied for many years to glass windows for tinting and other purposes and, due to its tensile strength, has had the incidental function of adding safety to the window in that it is difficult to tear and usually adheres to the window glass or glass fragments in the event of breakage. This is to say that if the glass becomes dislodged or is broken, the film holds the glass and/or glass particles, or at least most of the particles, in place.

In the usual application, a polyester material or film is applied to the glass and installed up to the surrounding gasket or frame. However, in Gross et al. U.S. Pat. No. 4,075,802 a film is disclosed as being adhesively secured to the plate glass, and a thin contoured strip is placed over the film edges and affixed to the window frame with wood screws. The disclosure appears to be particularly directed to residential applications having wood windows and relates to a rather primitive solution to the problem of securing the film perimeter to a window frame. However, Gross et al. do not disclose or suggest apparatus suitable for use in commercial settings wherein it is necessary that the securing system be not only functional but also aesthetically pleasing.

SUMMARY OF THE INVENTION

It is therefore an object of the present invention to provide an improved system for insuring retention of window glass in the event of its dislodgment or breakage.

It is another object of the present invention to provide an improved glass securing assembly particularly adapted for application to the common flat window frames typically used in commercial buildings.

A further object of the present invention is to provide apparatus of the type described including the use of a seal between the film covering the window pane and the edge securing means used to secure the film edges to the frame.

Briefly, a preferred embodiment of the present invention includes a film, means for adhesively affixing it to a window pane, and a securing means for clamping the edges of the film to the window frame or mullion and providing an aesthetically pleasing cap and seal around the window. The securing means includes a trough-shaped baseplate with upwardly projecting sides, the outer surfaces of which have captivation grooves extending along the length of the baseplate, and an inverted trough-shaped cap having a top and two sides which fit over the baseplate. The sides of the cap are provided with inwardly protruding ribs on the inside faces that are configured to snap into the captivation grooves for securing the cap to the baseplate so that the cap and baseplate form a four-sided, substantially rectangular framing assembly. The cap also has at least one narrow protruding rib extending inwardly on the window facing side from the level of the cap top, the rib being configured so as to leave a small gap between the rib and the window pane. A flexible gasket is engaged by the rib or ribs and used to maintain a sealing pressure against the film covering the window to prevent moisture and other contaminants from accumulating behind the cap.

An advantage to the present invention is that it provides a secure attachment of a window glass to a common flat window frame.

Another advantage of the present invention is that it includes a wind covering film and an aesthetically pleasing framing assembly that covers unsightly bolts or screws used in cooperation with a baseplate for clamping the film to the window frame.

A further advantage of the present invention is that it provides a positive and aesthetically acceptable seal between the film securing member and the window.

These and other objects and advantages of the present invention will no doubt become apparent to those skilled in the art after reading the following detailed description of the preferred embodiment illustrated in the several figures of the drawing.

IN THE DRAWING

DETAILED DESCRIPTION OF THE PREFERRED EMBODIMENT

Figure 1:
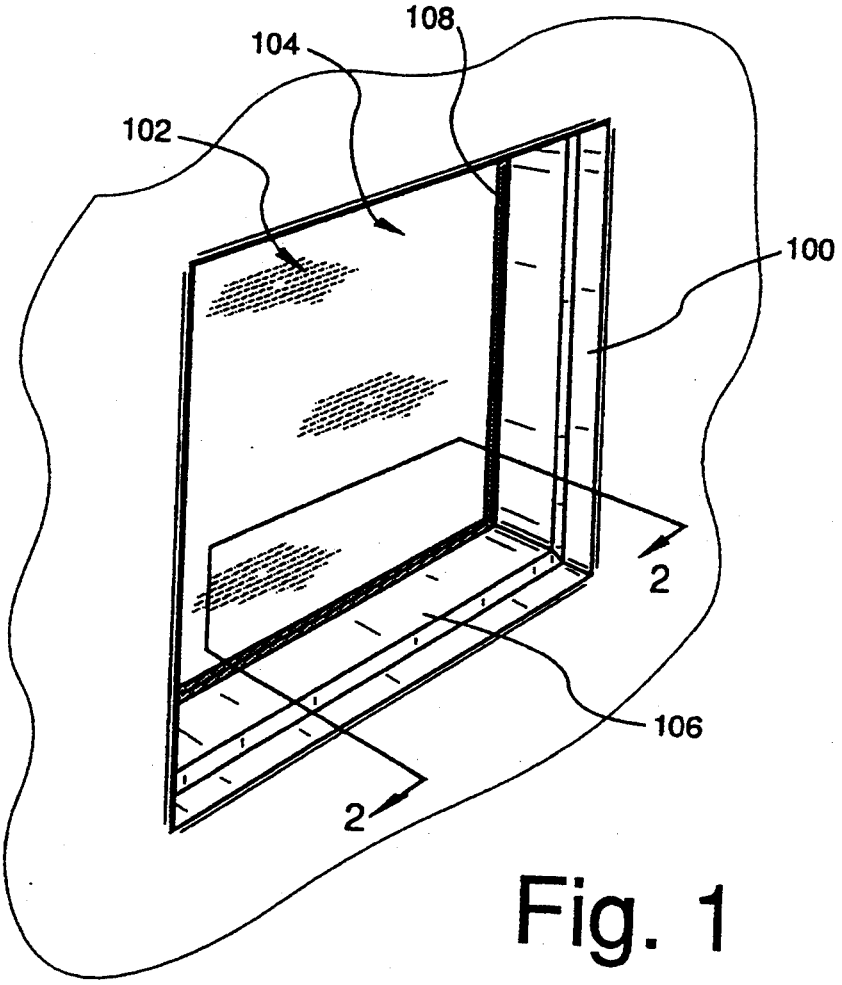
FIG. 1 illustrates the preferred embodiment of the present invention installed in a window frame.

Referring now to FIG. 1 of the drawing, there is shown a preferred embodiment of the present invention installed in a window frame 100. A film 102 is adhesively attached to a glass pane 104, the film edges being securely clamped to the window frame 100 by a securing assembly 106 in accordance with the present invention. A seal 108 is positioned between the securing assembly 106 and the film 102 covering the glass pane. The seal 108 keeps water and other contaminants from lodging between the securing assembly and the film covering the glass pane.

In operation, the film 102, being adhesively attached to the glass pane 104 as well as to the window frame, provides the benefit of retaining the pane in the event of its dislodgement from the window frame, and of retaining fragments of glass in the event the glass pane 104 is broken. The system provides protection to building occupants as well as others outside the building in the event of glass dislodgment by an earthquake, a hurricane, or an explosion, or if a projectile should break the glass, by retaining at least a high percentage of the glass particles. The system also provides resistance to projectiles and makes it more difficult for a potential unlawful entry of the building.

Figure 2A:
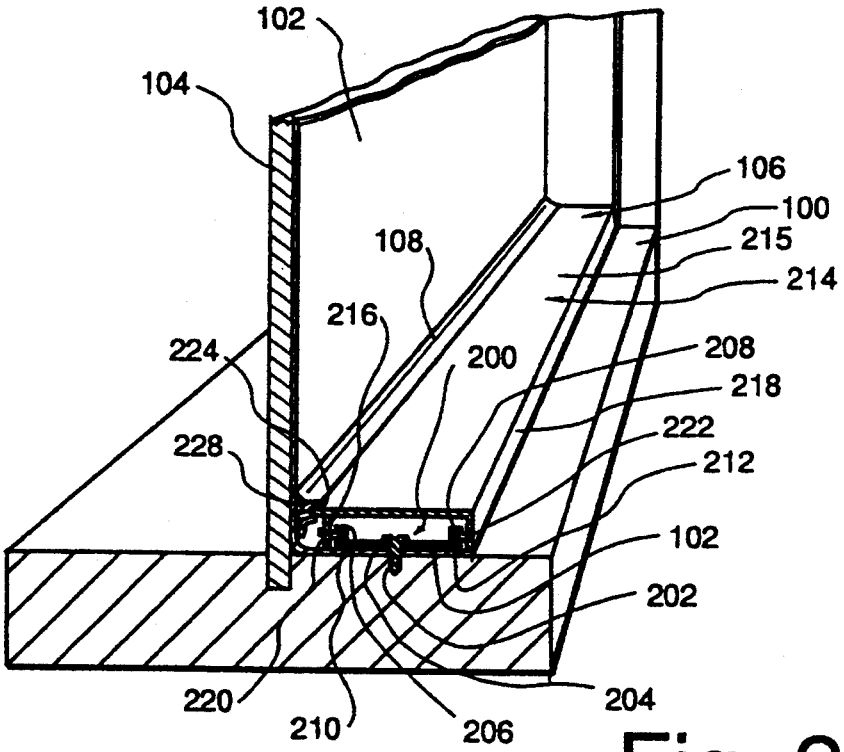
FIG. 2A shows a more detailed view and cross-section of the embodiment illustrated in FIG. 1.

FIG. 2A shows further detail of the assembly 106 and seal 108 through a view indicated by cross section line 2—2 of FIG. 1. As illustrated, the securing assembly 106 includes an elongated baseplate 200 that is positioned over the edge of the film 102 and is attached to the window frame 100 by a suitable fastening means 202, and thereby clamps the film edge 102 therebetween. The fastening means may be of the screw type or of any other well-known type including plastic or metal snap-in fasteners, rivets, etc. The baseplate 200 is preferably an extruded member having a trough-shaped cross section with a flat bottom 204, and sides 206 and 208 with grooves 210 and 212 extending the length of the plate 200.

Figure 2B:
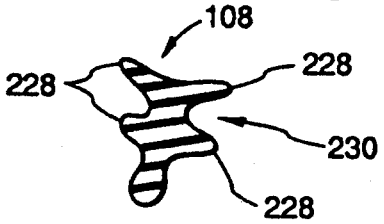
FIG. 2B is a cross-sectional view of the seal.

A snap-on cap 214, also of inverted trough shape, is defined by a top 215 and sides 216 and 218 having inwardly protruding ribs 220 and 222 which are forcibly engageable into grooves 210 and 212. At least one outwardly protruding rib 224 extends from the top 215 towards the glass pane 104 to form a capture means for the seal 108. The seal 108 is shown to have ribs 228 which bear against the film 102 (covering the glass pane 104) on one side and the cap 214 on the other side. The ribs 228 provide a captivating groove 230 for accepting the rib 224, and thereby secure and position the seal between the top 226 and film 102 covering the glass pane 104. The seal 108 is further clarified in FIG. 2B which shows a more detailed cross sectional view. Other forms of seals could of course also be utilized.

The baseplate 200 and threaded means 202 are first installed to hold the film edge 102 securely to the window frame 100. The cap 214 is then snapped in place to cover the baseplate 200 and threaded means 202. The seal 108 is thereafter forcibly inserted between the protruding edge 224 of the cap 214 and the film 102, the seal being retained by the ribs 228 in captured contact with the outwardly protruding rib 224, and serving to prevent contaminates from lodging between the securing member 106 and the film covered glass pane. Alternatively, the seal could be pre-attached to the cap 214 before it is snapped in place.

Figure 3:
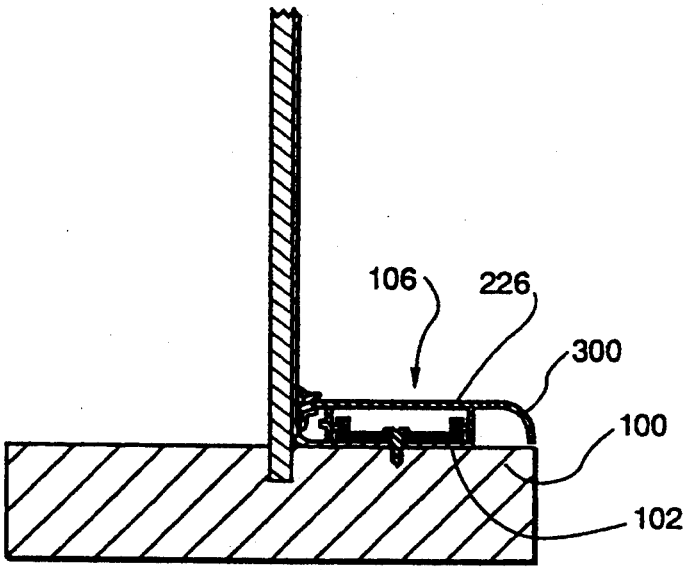
FIG. 3 shows an alternate embodiment including a modified cap having an extension to more fully cover an exiting window frame.

In FIG. 3 an alternate embodiment of the present invention is depicted including an extension 300 to the top 226 for providing full coverage of the window frame surface. The extension 300 provides a more aesthetically pleasing appearance by blending the snap on cap 106 with the window frame. It also serves as a protective cover for the frame.

Figure 4:
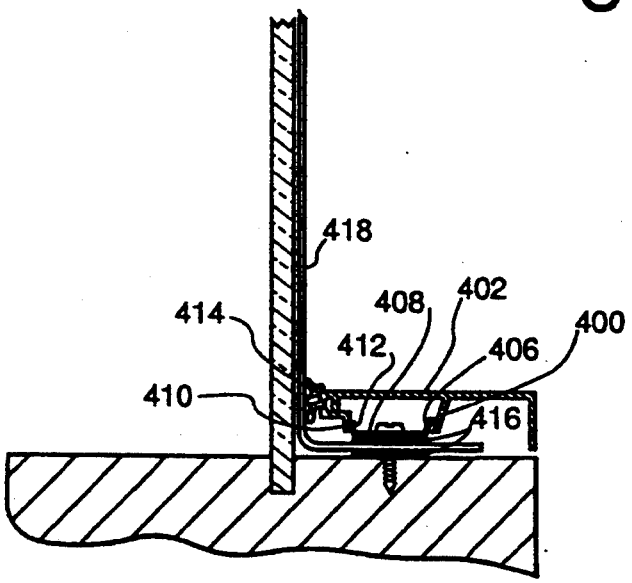
FIG. 4 shows another alternative embodiment.

Another alternative embodiment is depicted in FIG. 4 and differs from the FIG. 3 embodiment primarily in that the elongated internal rib 400 of the cap 402 and the corresponding side 404 of the baseplate 406 are slanted so that, in mating the cap to the baseplate, the rib 400 and side 406 can first be engaged and the cap rolled slightly to engage the wall 410 with the wall 412. Note also that the seal 414 is designed to be attached to the cap before it is snapped in place. This figure also illustrates the use of strips of adhesive foam tape 416 above and below the film 418 to protect it and/or to seal the edges of the film to the window frame where the film edges are not self-sticking.

Although a preferred embodiment of the present invention has been described above, it will be appreciated that certain alterations and modifications thereof will become apparent to those skilled in the art. For example, a similar structure and assembly could be used to secure glass panes within doors. It is therefore intended that the appended claims be interpreted as covering all such alterations and modifications as fall within the true spirit and scope of the invention.

What is claimed is:

1. A glass restraint system for securing a sheet of glass within a frame comprising:

a sheet of flexible plastic film for covering the sheet of glass to be restrained, the film being larger in dimension than the glass sheet so that each edge thereof extends beyond each edge of the glass sheet;

baseplate means having one at least segments with an accumulated length substantially equal to the perimeter of the frame and having first and second opposing baseplate sides with captivating grooves running along a substantial part of the length of said baseplate means, said baseplate means further having a plurality of mounting holes extending therethrough and distributed over the length of the segments, said baseplate means being positioned to sandwich the film edges between it and the frame;

fastening means for extension through said mounting holes and into the frame to clamp the film between said baseplate and the frame;

cap means of an elongated trough-like shape and of a length sufficient to cover said baseplate means, said cap means having a top portion, a first skirt portion extending from one side of said top portion and having an outer surface facing the glass sheet, and a second skirt portion extending from an opposite side of said top portion, said first and second skirt portions having inwardly protruding ribs configured to be forcibly engaged with said captivating grooves of said baseplate means, whereby the film being securely fastened between said baseplate means and the frame by said fastening means and said cap means being snapped into covering engagement with said baseplate means.

2. A glass restraint system as recited in claim 1 and further comprising an adhesive for adhesively affixing said film to the glass sheet.

3. A glass restraint system as recited in claim 2 and further comprising an elongated seal means for placement in a space separating said first skirt portion and the film covering the glass sheet so as to provide a seal therebetween.

4. A glass restraint system as recited in claim 3 wherein said seal means includes a securing groove formed along one side thereof and wherein said cap means further includes at least one narrow rib extending outwardly from said outer surface of said first skirt portion for mating with said securing groove to retain said seal means within the space between said cap means and the covered glass sheet.

5. A glass restraint system as recited in claim 4 wherein the top portion of said cap means extends beyond said second skirt portion to form a decorative skirt substantially covering a portion of the surface of the frame not engaged by said baseplate means.

6. A glass restraint system as recited in claim 3 wherein said gasket means includes a rib running the length thereof and wherein said outer surface of said skirt portion includes a slot extending along the length thereof for receiving said rib to retain said seal means in the space between said cap means and the covered glass sheet.

7. A glass restraint system as recited in claim 1 and further comprising a strip of resilient material affixed to said baseplate means to cushion the engagement between said baseplate means and said film edges.

8. A glass restraint system as recited in claim 1 wherein at least one of said first and second skirt portions lies in a plane that is not normal to the plane of said top portion.

* * * * *